US005702302A

United States Patent [19]

Gauselmann

[11] Patent Number: 5,702,302

[45] Date of Patent: Dec. 30, 1997

[54] GAMBLING MACHINE WITH DISPLAY MEANS FOR THE DISPLAY OF SYMBOLS

[75] Inventor: Michael Gauselmann, Espelkamp, Germany

[73] Assignee: Atronic Casino Technology Distribution GmbH, Lübbecke, Germany

[21] Appl. No.: 531,500

[22] Filed: Sep. 21, 1995

[30] Foreign Application Priority Data

Sep. 23, 1994 [DE] Germany ..... 44 34 128.8

[51] Int. Cl.[6] ..... A63F 9/24

[52] U.S. Cl. ..... 463/20

[58] Field of Search ..... 463/16, 17, 18, 463/19, 20, 21

[56] References Cited

U.S. PATENT DOCUMENTS 4,240,635 12/1980 Brown ..... 463/20

5,588,913 12/1996 Hecht ..... 463/19

*Primary Examiner*—George Manuel

*Attorney, Agent, or Firm*—Horst M. Kasper

[57] ABSTRACT

The stopped rotating bodies of coin-operated gambling machines display a symbol combination which decides a win or non-win situation. The stop positions of the rotating bodies are determined with a random number generator. A random number generator is provided, which allows, without large expenditures, to adapt quickly the respective number of symbols to be displayed and the respective display frequency. A result output region is coordinated to each symbol. The symbol sequence is determined for the respective result output region with a pseudo-random number. The pseudo-random number is compared with a predetermined number from the respective result output region and in case of a numerical coincidence between pseudo-random number and predetermined number, a symbol of a rotating reel stop position and coordinated to the result output region, is displayed.

8 Claims, 4 Drawing Sheets

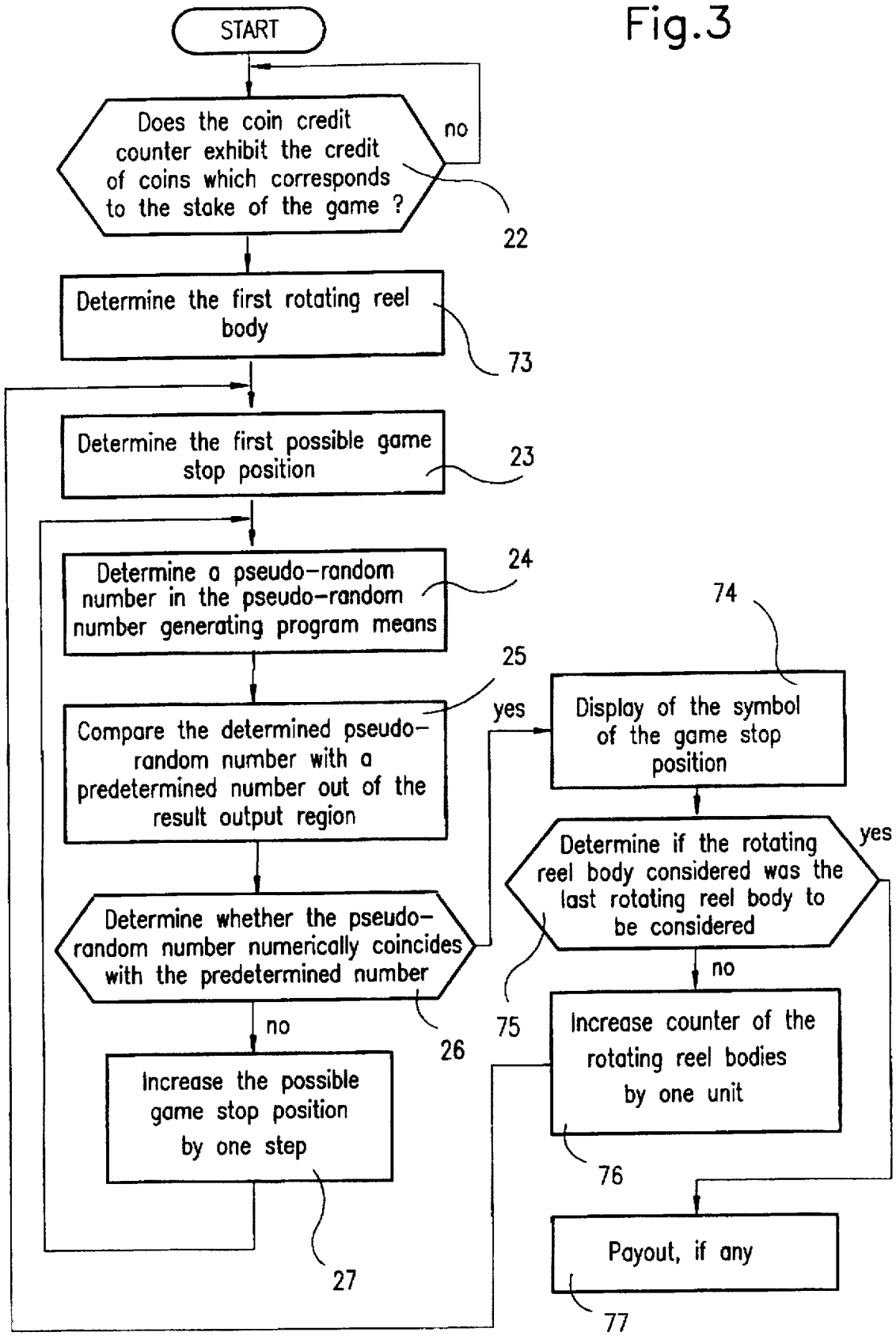
Fig.3
START
Does the coin credit counter exhibit the credit of coins which corresponds to the stake of the game ?
no
22
Determine the first rotating reel body
73
Determine the first possible game stop position
23
Determine a pseudo-random number in the pseudo-random number generating program means
24
Compare the determined pseudo-random number with a predetermined number out of the result output region
25
Determine whether the pseudo-random number numerically coincides with the predetermined number
26
yes
no
Increase the possible game stop position by one step
27
74
Display of the symbol of the game stop position
Determine if the rotating reel body considered was the last rotating reel body to be considered
75
yes
no
Increase counter of the rotating reel bodies by one unit
76
Payout, if any
77

| Symbol Position Rotating Reel Body | Result Output Region | Predetermined Number |
|---|---|---|
| 0 | 0.....35 | 6 |
| 1 | 0.....17 | 3 |
| 2 | 0.....21 | 18 |
| 3 | 0.....15 | 13 |
| . | . | . |
| . | . | . |
| . | . | . |
| . | . | . |
| . | . | . |
| . | . | . |
| . | . | . |
| . | . | . |
| . | . | . |
| . | . | . |
| . | . | . |
| . | . | . |
| . | . | . |
| 17 | 0..2 | 0 |
| 18 | 0..2 | 1 |
| 19 | 0..0 | 0 |

21

Fig.4

GAMBLING MACHINE WITH DISPLAY MEANS FOR THE DISPLAY OF SYMBOLS

BACKGROUND OF THE INVENTION

1. Field of the Invention

The invention relates to a gambling machine with a display means for displaying symbols.

2. Brief Description of the Background of the Invention Including Prior Art

The coin-operated gambling machine is known from the German printed patent document DE AS 22 32 107, where in each case also a counter is switched synchronously to a rotation during the rotation of the rotating body. The random number generator determines the points in time at which the rotating body is to be stopped. The individual indications of the counter are read and after the stopping of the rotating body and the individual indications of the counter are combined by switching-technical means such as that the result of the play or game is determined.

SUMMARY OF THE INVENTION

1. Purposes of the Invention

It is an object of the invention to improve the entertainment machine of the recited kind such that the pseudo-random number generator can be adapted quickly and without large expenditures to the respective number of symbols to be displayed and to the frequency of displaying the individual ones of the symbols available.

These and other objects and advantages of the present invention will become evident from the description which follows.

2. Brief Description of the Invention

The gambling machine according to the invention is associated with the advantage that the pseudo-random number generator meets all the requirements which are to be fulfilled relative to an easy and quick adjustability, in particular for the payout of the winning situations. By proper formation of the result output region of the pseudo-random number generator, the uniform distribution can be corrected even while using only few display symbols on the rotating reel bodies. In particular, the payout quota can be changed during times when little gambling takes place by changing of the result output region of the pseudo-random number generator.

According to the present invention there is provided for a method of operating a gambling machine. A game is initiated. A possible game stop position of a displayed rotating reel is being determined. A pseudo-random number is being determined with a pseudo-random number generating means for the possible game stop position. The pseudo-random number is being compared with a predetermined number within a range of pseudo-random numbers generatable for the possible game stop position. The possible game stop position are increased by a step in case the pseudo-random number does not numerically coincide with the predetermined number and another pseudo-random number is being determined and the above steps are repeated following such determination. The symbol associated with the game stop position is displayed in case the pseudo-random number numerically coincides with the predetermined number and a winning amount, if appropriate, is paid out for the symbol displayed.

Upon initiating a game, a first displayed rotating reel can be determined and the recited procedure for this displayed rotating reel can be performed. The presence of a last displayed rotating reel can be determined upon displaying the symbol associated with the game stop position. The operation can be transferred to a displayed rotating reel next in sequence if the last displayed rotating reel was not under consideration, and a possible game stop position can be determined for the displayed rotating reel next in sequence and the steps recited above can be performed following to such determination of a possible game stop position.

Preferably, the predetermined number is associated with the value "0".

The range of pseudo-random numbers of the result output region can be different for each game stop position.

The symbol can be displayed on display means. A win or non-win situation can be indicated with the symbol displayed. A microcomputer can be employed for sequential control of above Operational steps.

The gambling machine can be actuated by manually contacting buttons.

The displayed rotating reel can be provided by a rotating reel body forming part of a gambling machine.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention:

FIG. 3 is a view of a schematic flow diagram illustrating the steps of the present method;

FIG. 4 is a view of a table showing a coordination of the display positions and the definition region of the pseudo-random number generator.

DESCRIPTION OF THE INVENTION AND PREFERRED EMBODIMENT

Figure 1:
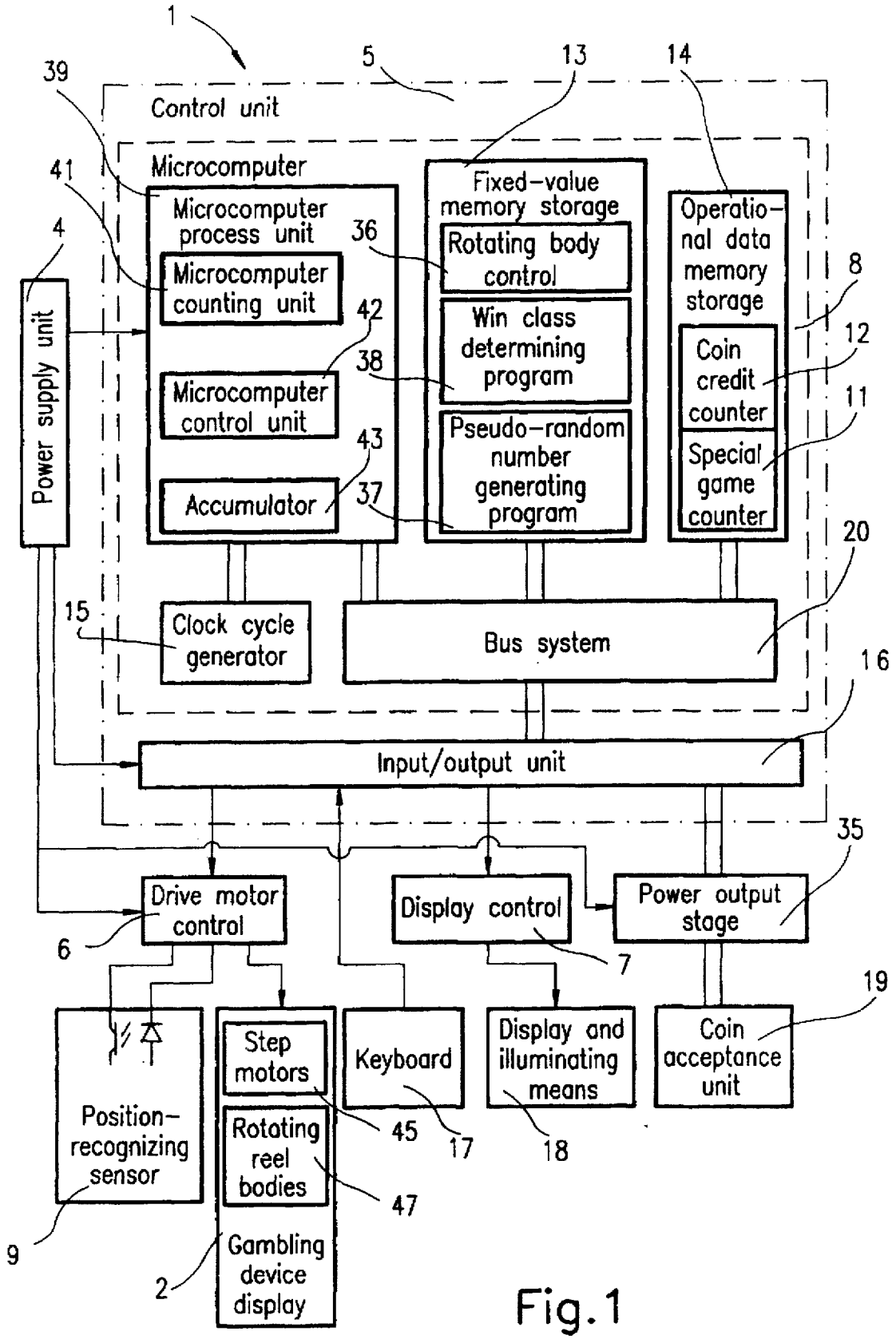
FIG. 1 shows a schematic block circuit of an apparatus for determining pseudo-random numbers and for displaying the game or play results at a coin-operated gambling machine.

The present invention provides for an entertainment machine or a gambling machine including a gambling device display 2 for displaying symbols, where the symbols indicate a win or non-win situation. A control unit 5 includes a microcomputer 8 for the sequential control of operation. The symbol to be displayed is determined by a pseudo-random number generating program means 37. A result Output region is coordinated to each symbol. A pseudo-random number is determined in symbol sequence with the pseudo-random number generating program 37 from within a respective result output region until the determined pseudo-random number numerically coincides with a predetermined number from the respective result output region. The symbol coordinated to the result output region is displayed with the display means in case of a numerical coincidence.

The block circuit diagram illustrated in FIG. 1 and designated with reference numeral 1 represents the elements and their mutual connections necessary to realize an embodiment of the present invention of a coin-operated gambling machine with win possibility. The block circuit diagram 1 comprises a display unit or gambling device display 2, a power supply unit 4, 204, a control unit 205 with a microcomputer 208 and a drive motor control 6, a display control 7, as well as a power output stage for the display elements or display and illuminating means. The control unit 5, 205, the drive motor control 6, and the power output stage 35, 235 have an input connected to an output of the power supply unit 4, 204. The display unit or gambling device display 2 has an input connected to an output of the drive motor control 6. The control unit 5, 205 includes a microcomputer 8, 208 and an input/output unit 16, 216. The display control 7, 207 has an input connected to an output of the input/output unit 16, 216.

The display unit or gambling device display 2 comprises disk-shaped or reel-shaped rotating bodies. Symbols to be displayed are present on the displayed rotating reels such as provided by the rotating reel bodies 47 of the gambling device display 2. Each rotating reel body 47 is associated with a position-recognizing sensor 9 connected to the drive motor control 6. The rotating reel bodies 47 are driven by step motors 45. The step motors 45 and the position-recognizing sensors 9 are connected by means of a drive motor control 6 to the control unit 5, where the control unit 5 includes the microcomputer 8. The microcomputer 8 includes a microcomputer process unit 39, 239 with a microcomputer counting unit 41, 241, a microcomputer control unit 42, 242, and an accumulator 43, 243.

The microcomputer 8 of the control unit 5 further comprises a fixed-value memory storage 13 or a read-only memory with a rotating body control 36, a pseudo-random number generating program means 37, and a win class determining program 38, 238 furnished as a table, where a stop position and a result region are coordinated to each symbol in the table. The result region defines the numbers region from which the pseudo-random number generator draws a pseudo-random number. The microcomputer 8, 208 of the control unit 5, 205 further comprises an operational data memory storage 14, 214 or a random access memory, where the coin, currency or token credits and the special games or extra plays are recorded, as well as the other device components necessary for the operation of such a unit, such as a buffer, a clock cycle generator 15, 215 connected to the microcomputer process unit 39, 239, a bus system 20, 220 connected to the microcomputer process unit 39, 239, the fixed-value memory storage 13, 213, and the operational data memory storage 14, 214, and the like. An input/output unit 16, 216, connected to the bus system 20, 220, forms the interface between the microcomputer 8, 208, and the peripherals 6, 7, 207, 17, 217, 35, 235 connected to the input/output unit 16, 216. The peripherals comprise operating elements 17, 217 formed as keys or buttons, display and illuminating means 18, 218 for presenting a status of the coin, currency or token credit counter 12, 212 and for presenting the contents of the special game and extra play counter 11, 211 of the microcomputer 8, 208, as well as a coin acceptance unit 19, 219 connected to the power output stage 35, 235. The coin acceptance unit 19, 219 includes a coin validator and a payout unit. These peripheral devices are disposed at the front side of the gambling machine.

The power supply unit 4, 204 provides the voltage supply for the complete gambling machine. The required voltages are derived at a grid power transformer contained in the power supply unit 4, 204. The voltages delivered from the grid power transformer are rectified and delivered to the various device groups.

Figure 2:
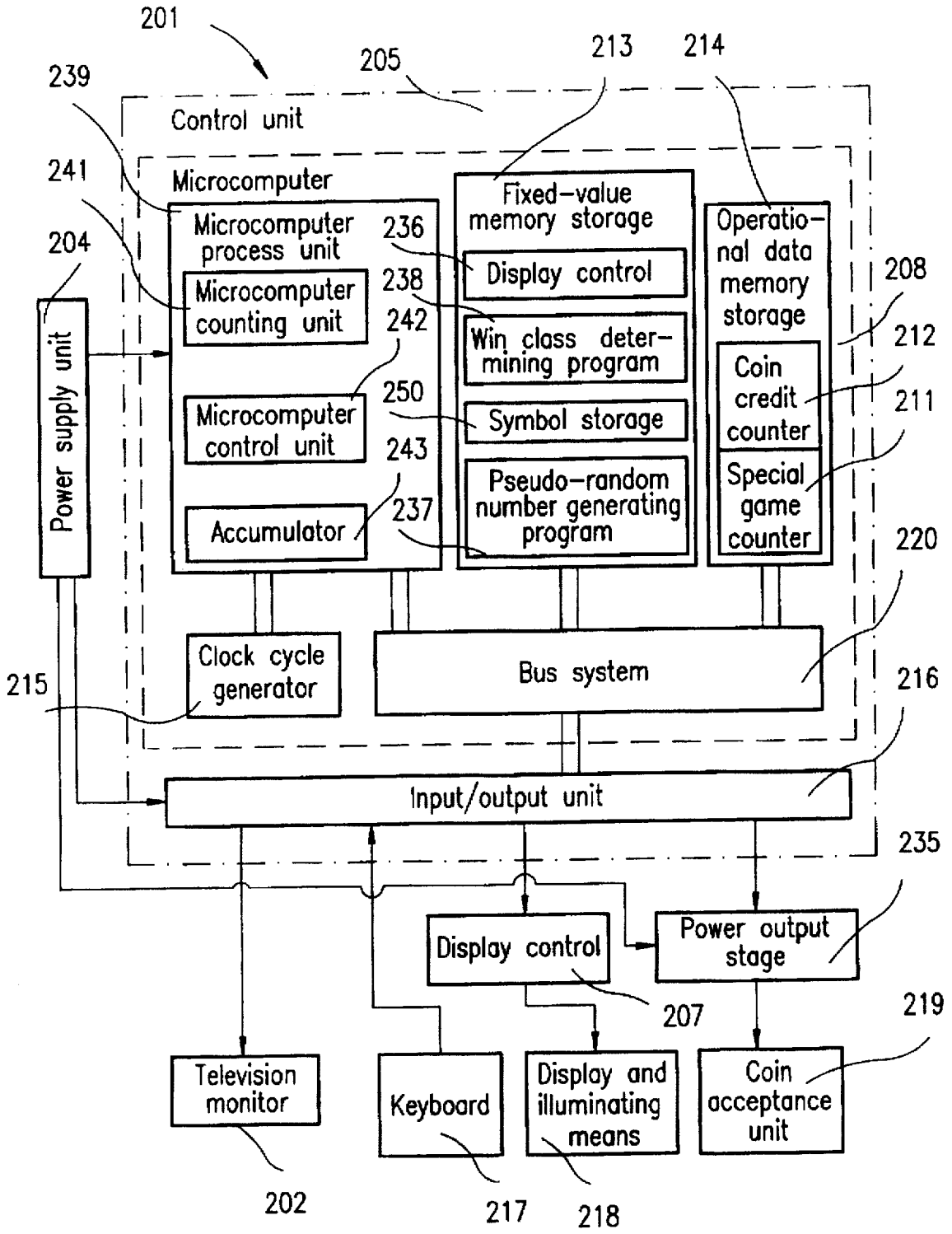
FIG. 2 is a view of a schematic diagram showing a second embodiment of an apparatus for the determination of pseudo-random numbers and for the display of the gambling results at a coin-operated entertainment apparatus, provided as a block circuit diagram.

The block circuit diagram illustrated in FIG. 2 shows an alternate circuit diagram 201, where the recognizing device and the gambling device display are replaced by a television monitor, by a personal computer monitor, or by a video terminal. In this case, the position-recognizing sensor 9, the drive motor control 6, and the gambling device display 2 with rotating reel bodies are eliminated relative to the embodiment of FIG. 1. Instead, for example, a television monitor 202 is connected to the input/output unit 216 and controlled by the microcomputer 208. In addition, the control of the rotating reel body present in the fixed-value memory storage 13 of FIG. 1 is replaced by a display control 236 and, in addition, a symbol storage 250 is included in the fixed-value memory storage 213, e.g. represented by a read only memory ROM. The symbol storage 250 contains the symbols to be presented on the television monitor 202. The use of a television monitor 202 excludes possibilities of manipulation present in the case of rotating reel bodies, e.g. of a mechanical nature, and, consequently, a checking of the game stop positions of the rotating reel bodies by a position recognizing device is no longer required.

In case the invention method is performed in connection with the apparatus embodiment of FIG. 2, then the microcomputer 208 of the control unit 205 determines with the pseudo-random number generating program means 237 a pseudo-random number for the symbol of a first possible game stop position. If the result is not equal to zero and the pseudo-random number does not coincide with a predetermined number in the result output region, then an additional or new pseudo-random number is generated for the symbol of the next following possible stop position. On the other hand, if the pseudo-random number is equal to the predetermined number in the result output region, then the symbol considered for being drawn is read out of the symbol storage 250 through the bus system 220 and delivered through the input/output unit 216 to the display television monitor 202.

According to a preferred embodiment, the predetermined number to be compared with the pseudo-random number is selected to be zero for each result output region. The adaptation of pseudo-random numbers generated by the pseudo-random number generating means 237 can be performed by a modulo division of the pseudo-random number through the number of elements of the result output region, wherein the modulo residue represents the pseudo-random number to be compared with the predetermined number.

A coordination table is illustrated in FIG. 4 and shows the connection between the stop position of the symbol to be displayed and the result region, from which the pseudo-random number generator draws a pseudo-random number. A result output region is associated with each symbol combination of the rotating reel body. The number N of elements in the result output region can be different for each symbol combination, i.e., for each rotating reel body stop position. The number N of elements is associated with the probability that this symbol combination is displayed. As will be seen later, the larger the number N, the smaller the probability that the associated symbol combination will be displayed.

The number of elements N in the result output region can be simply modified by setting the gambling apparatus and, in particular, these elements N are provided in table form according to FIG. 4. According to a preferred embodiment, a simple editing of the table of the result output regions in the application program allows to change quickly and without larger effort the number-of the symbols displayed as well as the probability of drawing a particular symbol combination. A changing of the drawing algorithm is not necessary according to the invention method in order to change the symbol a displayed or the probability of drawing such symbol combination.

FIG. 3 illustrates the steps being performed in connection with the invention method. The coin unit 19, 219 in connection with the coin credit counter 12, 212 determines if sufficient coins, currency or tokens to initiate a game have been deposited. Then, a determination 73 is made that the following decisions and manipulations relate to the first rotating reel body.

Thereupon, a second determination 23 is made that the following steps are to be performed relative to the first possible game stop position. Then, a determination 24 of a pseudo-random number is made in the pseudo-random number generating program means 37, 237. The determined pseudo-random number is compared 25 with a predetermined number out of the result output region. A determination 26 is made whether the pseudo-random number numerically coincides with the predetermined number or not. If coincidence is not present, then the next operation 27 increases the possible game stop position by one step and returns the process for determination 24 of another pseudo-random number.

If coincidence is present, then the symbol corresponding to the game stop position is displayed (operation 74). The next operation 75 determines if the rotating reel body considered was the last rotating reel body to be considered. If it is the last rotating reel body, then an operation 77 performing payout, if any, follows. If the rotating reel body considered was not the last rotating reel body, then operation 76 follows and increases a counter of the rotating reel bodies by one unit. Thereupon, control is returned to the operation 23 for determining the first possible game stop position of the rotating reel body now under consideration. The steps performed for the preceding rotating reel body are now performed for the rotating reel body now under consideration.

If the coin, currency and/or token credit memory storage exhibits a stake credit amount, then a game is initiated and the drive motors of the rotating bodies are furnished in the following with current by the control unit 5 by way of the drive motor control 6. The stop position of each rotating reel body is determined by the control unit 6 with a pseudo-random number generator. The pseudo-random number generator starts at the stop position 0 for the determination of a game stop position. A pseudo-random number is determined with the pseudo-random number generator from the numbers in the result region coordinated to this game stop position, for example 0 to 35. This pseudo-random number is compared with a predetermined number from the result region of the game stop position 0. If the pseudo-random number is equal to the predetermined number, then the rotating reel body is stopped in the game stop position 0 coordinated to the result region where the match between predetermined number and pseudo-random number occurred. If no numerical coincidence exists between the predetermined number value within the result region and the pseudo-random number, then a pseudo-random number is drawn for the subsequent game stop position 1 from within the result region of the game stop position 1, where this result region can deviate from the result region at the preceding game stop position 0. In the following, the control unit 5 checks if a numerical .coincidence is present between the predetermined number, which is within the result region of the stop position 1, and the pseudo-random number for the game stop position 1. In case of a lack of numerical coincidence, the result region of the game stop position 2 is used in connection with a determination of the pseudo-random number by the pseudo-random number generating means for the subsequent game stop position 2 and it is tested if a numerical coincidence is present between the predetermined number associated with the game stop position 2 and the pseudo-random number associated with the game stop position 2. In case of a numerical coincidence, the symbol coordinated to the game stop position 2 is displayed by the stopped rotating reel body. As long as no numerical coincidence is present between the predetermined number of the respective game stop position and the pseudo-random number generated for such game Stop position, it is determined for each possible subsequent game stop position of the rotating reel body if there exists a numerical coincidence between the respective predetermined number and the respective pseudo-random number. In case the sequence of game stop positions is exhausted, it is possible to restart the procedure again for the game stop position 0 by generating again a pseudo-random number associated with the game stop position 0.

The determination of the symbol to be displayed is performed for all rotating reel bodies or, respectively, for all display fields of a picture tube according to the above recited method.

It will be understood that each of the elements described above, or two or more together, may also find a useful application in other types of gambling machines differing from the types described above.

While the invention has been illustrated and described as embodied in a gambling machine with display means for the display of symbols, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of operating a gambling machine comprising the steps:

initiating a game;

determining a certain game stop position of a displayed rotating reel;

determining a pseudo-random number with a pseudo-random number generating means for the certain game stop position;

comparing the pseudo-random number with a predetermined number within a range of pseudo-random numbers generatable for the possible game stop position;

increasing the certain game stop position by a step where the pseudo-random number does not numerically coincide with the predetermined number and determining another pseudo-random number and repeating the above steps following such determination;

displaying the symbol associated with the game stop position when the pseudo-random number numerically coincides with the predetermined number and paying out a winning amount when coordinated to the symbol displayed.

2. The method according to claim 1, further comprising determining upon initiating a game a first displayed rotating reel and performing the recited procedure for this displayed rotating reel;

determining the presence of a last displayed rotating reel upon displaying the symbol associated with the game stop position;

transferring operation to a displayed rotating reel next in sequence if the thereto preceding rotating reel was the last displayed rotating reel, and determining a possible game stop position for the displayed rotating reel next in sequence and performing the steps recited above following to such determination of a possible game stop position.

3. The method according to claim 1, wherein the predetermined number is associated with the value "0".

4. The method according to claim 1, wherein the range of pseudo-random numbers of a result output region is different for each game stop position.

5. The method according to claim 1, further comprising displaying the symbol on display means;

indicating a win or non-win situation with the symbol displayed;

employing a microcomputer for sequential control of above operational steps.

6. The method according to claim 1, further comprising actuating the gambling machine by manually contacting buttons located on the gambling machine.

7. The method according to claim 1, wherein the displayed rotating reel is provided by a rotating reel body forming part of a gambling machine.

8. An entertainment machine comprising a display means for displaying symbols, where the symbols indicate a win or non-win situation;

a control unit with a microprocessor for sequential control of operation, wherein the symbol to be displayed is determined by a random number generator, wherein a result output region is coordinated to each symbol, and wherein a pseudo-random number is determined in symbol sequence with the pseudo-random number generator from within a respective result output region until the determined pseudo-random number numerically coincides with a predetermined number from the respective result output region, and wherein the symbol coordinated to the result output region is displayed with the display means when a numerical coincidence is present.

* * * * *